US006129616A

United States Patent [19]

Klotz

[11] Patent Number: 6,129,616

[45] Date of Patent: Oct. 10, 2000

[54] PORTABLE CUTTING TOOL SHARPENER

[75] Inventor: Adolf Klotz, Forst, Germany

[73] Assignee: Heinz Weschenfelder, Forst, Germany

[21] Appl. No.: 09/255,868

[22] Filed: Feb. 23, 1999

[30] Foreign Application Priority Data

Apr. 21, 1998 [EP] European Pat. Off. ..... 98107202

[51] Int. Cl.[7] ..... B24B 23/00

[52] U.S. Cl. ..... 451/349; 451/524; 451/461

[58] Field of Search ..... 7/158, 167; 16/110 R; 451/349, 523, 524, 461

[56] References Cited

U.S. PATENT DOCUMENTS 3,861,987 1/1975 Martin .
3,894,362 7/1975 Graves .
4,231,199 11/1980 Gomez et al. .
4,550,632 11/1985 Inman .
5,397,262 3/1995 Lii ..... 451/241

*Primary Examiner*—Timothy V. Eley

[57] ABSTRACT

The invention comprises a device for sharpening cutting tools, such as knives, scissors, etc., with an abrasive or steel piece. The device is characterized by a U-shaped body formed as an open handle and having on its underside a supporting or bracing surface. The U-shaped body is equipped with a projecting piece receiver extending toward the front of the device and designed to hold the abrasive or steel piece. Below the receiver is a ceramic rod which can be shifted lengthwise toward the front and which serves to smooth irregularities in the cutting tool edge being sharpened.

8 Claims, 2 Drawing Sheets

PORTABLE CUTTING TOOL SHARPENER

BACKGROUND OF THE INVENTION

1. Technical Field

The present invention pertains to apparatus and methods for sharpening cutting tools, such as knives, scissors, etc., with an abrasive or steel piece.

2. Discussion of the Prior Art

Devices for sharpening cutting tools are known in the art and, in general, typically include a round or flat handle on which an abrasive or steel sharpening member is mounted. To effect grinding, a knife blade must be drawn over the abrasive member, resulting in the knife blade being sharpened. One disadvantage of prior art devices of this type is that they can be operated only in a positionally unstable hand-held mode; in other words, they cannot be braced against a fixed surface. As a consequence, the inexperienced user, rather than sharpening the cutting tools, may actually dull them by holding the tool and device incorrectly.

OBJECTS AND SUMMARY OF THE INVENTION

An object of the present invention is to provide a device of the type described above which can be used effectively, even by the inexperienced user, to sharpen cutting tools.

The stated object is attained by means of a device for sharpening cutting tools comprising an abrasive or steel sharpening element, typically having an elongated sharpening edge, and characterized by a generally U-shaped body designed as an open handle and equipped with a bracing or supporting surface on its underside. The U-shaped body is also provided with a projecting member extending towards the front end of the sharpener device and designed to hold the abrasive or steel sharpening element. Beneath this projecting member is a ceramic rod that can be selectively shifted lengthwise toward the front of the sharpener device.

The sharpener device of the present invention provides the considerable advantage of being able to be stably supported on or braced against a fixed surface, such as a table, and firmly held in place by the user via the U-shaped body handle. The cutting tool is then sharpened by simply drawing its cutting edge across the positionally fixed abrasive or steel sharpening element. In addition, the ceramic rod positioned below the projection, which can be shifted lengthwise between retracted and extended positions, provides the option of smoothing out irregularities in the cutting edge of the tool being sharpened when the cutting edge is drawn across the rod. In accordance with one preferred embodiment, the projection holding the abrasive or steel sharpening element can be designed to tilt upward at an angle of approximately 10°; this permits particularly easy handling and use of the sharpener device of the present invention.

The ceramic rod can be fastened to a plastic actuator component mounted such that it can shift in a recess or slot in the lower portion of the U-shaped body to move the ceramic rod between its retracted and extended positions.

Finally, the projecting member holding the abrasive or steel sharpening element may be equipped with a recessed area in its lower section capable of being covered with a cap that can be slid onto the U-shaped body. The base surface of the cap may be coplanar with the base surface of the U-shaped body to permit the cap to serve not only to protect the ceramic rod, but also to improve the support stability of the U-shaped body in use.

With the help of the accompanying drawings, the sharpener device of the present invention will be described in greater detail in the form of one preferred exemplary embodiment.

DESCRIPTION OF PREFERRED EMBODIMENT

Figure 3:
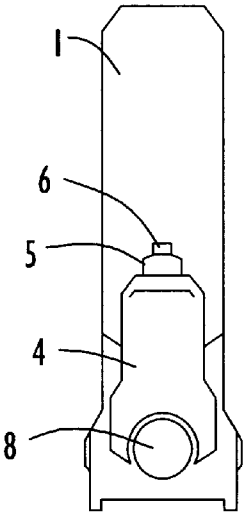
FIG. 3 is a front view in elevation of the sharpener device of the present invention.
Figure 2:
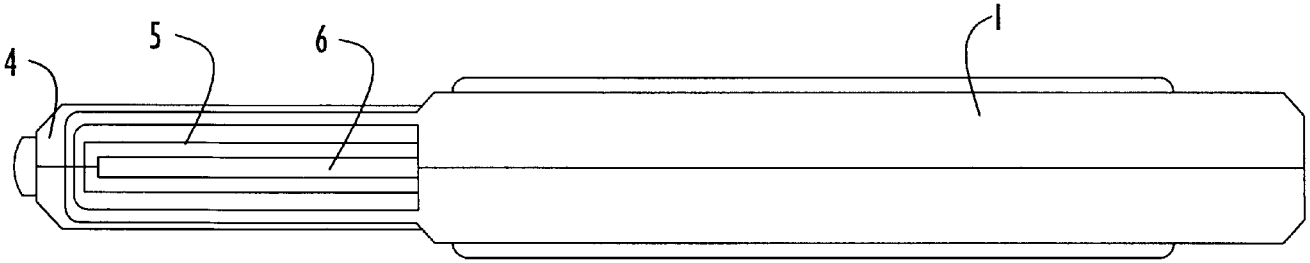
FIG. 2 is a top view in plan of the sharpener device of FIG. 1.
Figure 1:
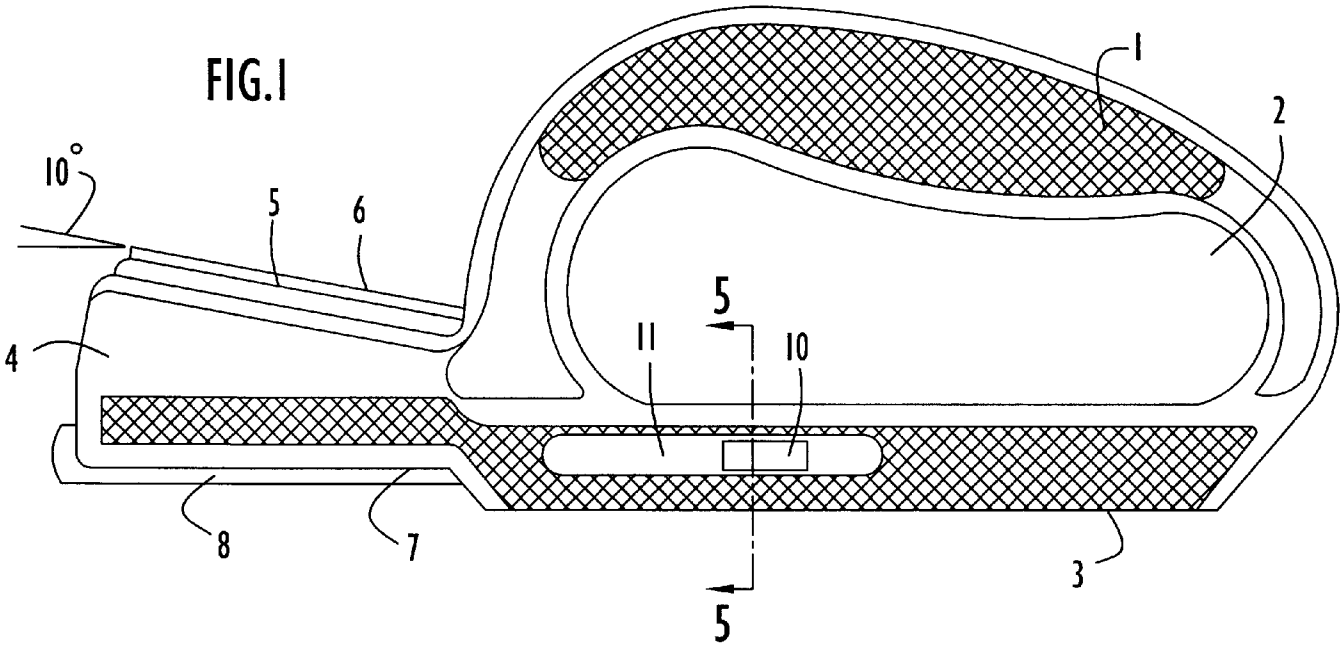
FIG. 1 is a side view in elevation of the sharpener device of the present invention.
Figure 4:
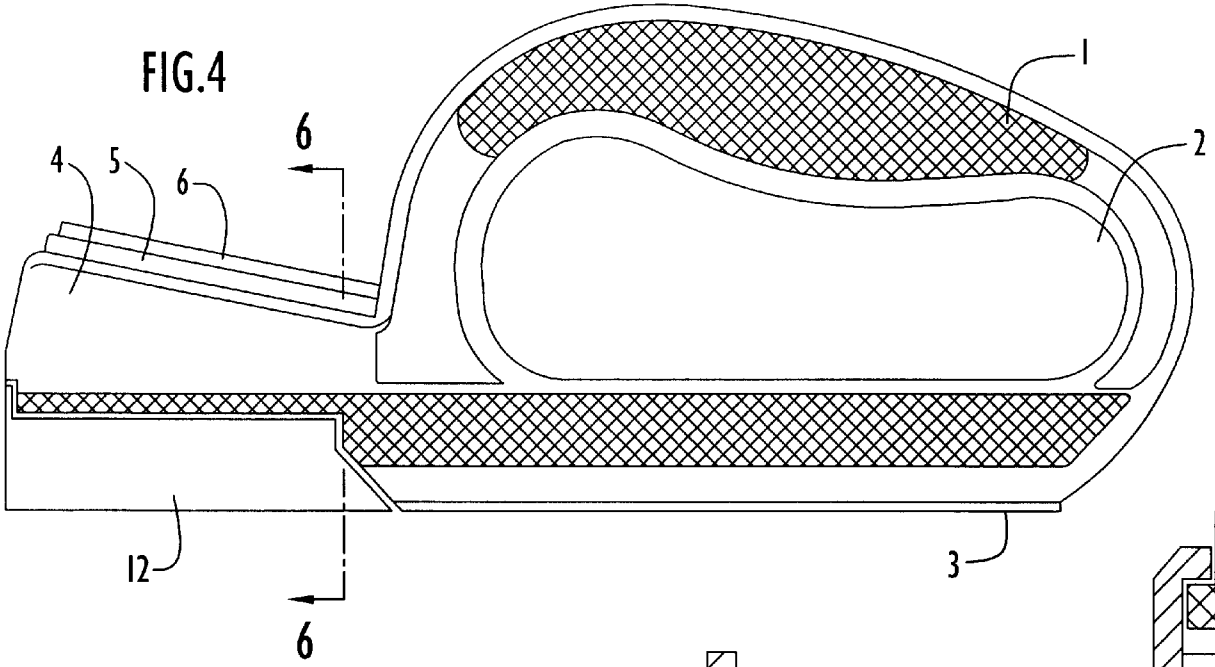
FIG. 4 is a top view in elevation similar to FIG. 2 but with the protective cap in place.
Figure 6:
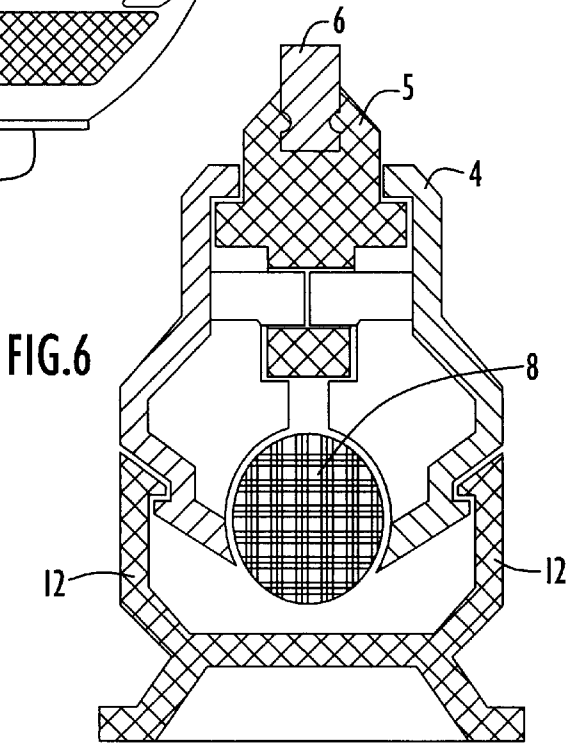
FIG. 6 is a view in section taken along lines 6—6 of FIG. 4.
Figure 5:
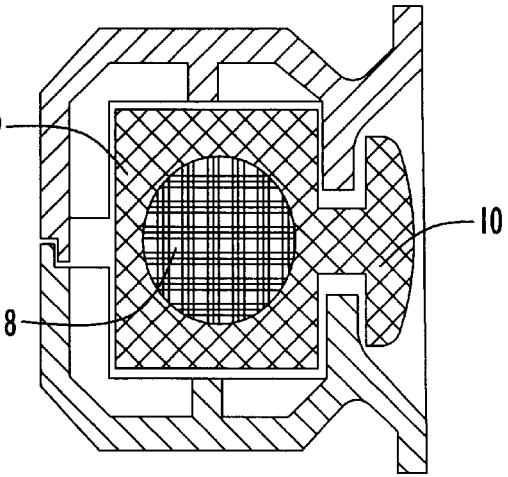
FIG. 5 is a view in section taken long lines 5—5 of FIG. 1.

As illustrated in the drawings, the sharpener device of the present invention is comprised of a U-shaped body 1 that is formed as a handle with an opening 2 extending through the handle and designed for securely holding the device in one's hand. The body 1 is equipped on its underside with a flat supporting or bracing surface 3 which can be used to brace the body firmly against a stable surface, such as a table or counter top, floor, wall, etc.

At its forward end U-shaped body 1 is equipped with a receiver piece 4 extending forwardly and into which a plastic holder 5 is inserted to hold an abrasive or steel sharpening element 6. The projecting receiver piece 4 also extends upwardly at a small angle so that the exposed upper surface of the sharpening element 6 forms an angle of approximately 10° with bracing surface 3. In the preferred embodiment, sharpening element 6 takes the form of a rod but can take any other shape consistent with the functions described herein.

On its underside, the projecting receiver piece 4 is provided with a recessed area 7 that holds a ceramic rod 8 of round cross-section and capable of being shifted lengthwise. This ceramic rod can be used to balance or smooth out irregularities or undulations in the cutting tool being abraded or sharpened by drawing the tool cutting edge across the ceramic rod. To this end, the ceramic rod 8 is connected to a plastic actuator 9 positioned such that it can slide within the lower section of U-shaped body 1. To enable it to shift lengthwise, actuator 9 is provided with a nub 10 extending into a longitudinally extending groove 11 defined in the U-shaped body so that nub 10 can be moved longitudinally in the groove by the user's fingers.

The sharpener device of the present invention provides the considerable advantage of the U-shaped body 1 being braceable on a fixed surface, such as a table or counter top, floor or wall when held firmly and forcefully urged against that surface with one hand. With the other hand, then, the cutting tool edge to be sharpened can be drawn across the abrasive or steel sharpening element 6.

To protect the ceramic rod 8 a cover 12 can be pressed onto and over the lower side of the projecting piece 4. The bottom surface of cover 12 is preferably flat and, when in place on piece 4, coplanar with surface 3 to further stabilize the sharpener device against a fixed surface when the device is in use.

What is claimed:

1. A hand held apparatus for sharpening a cutting edge of a cutting tool comprising:

a body having a handle on a first side thereof capable of being firmly gripped by one hand of the operator of the apparatus, said body having a flat bracing surface disposed at a second side of the body opposite its first side such that, when said handle is gripped by said one hand of the operator, said bracing surface can be forcefully urged into positionally stable relation by said one hand of an operator against a fixed support surface such as a table or countertop, floor or wall;

a sharpening element held by said body in a position wherein the cutting edge of the cutting tool being sharpened can be held in a second hand of the operator and drawn along the sharpening element while said bracing surface is being urged against said fixed support surface; and a ceramic rod retained on said body for selective movement between retracted and extended positions relative to said body, said ceramic rod when in said extended position being capable of smoothing irregularities or undulations in the cutting edge of said cutting tool in response to the cutting edge being drawn across the ceramic rod.

2. The apparatus of claim 1 wherein said ceramic rod is disposed along said second side of said body, said apparatus further comprising a removable protective cap attachable to said body to cover and protect said ceramic rod, said cap having a flat surface, which is coplanar with said bracing surface when the cap is attached to the body, to thereby enhance the positional stability of the bracing surface against the fixed surface.

3. The apparatus of claim 2 wherein said body has a longitudinally extending slot defined therein, and further comprising a transverse projection extending from said ceramic rod into said slot, said projection being significantly smaller in a lengthwise dimension of said ceramic rod than the length of said slot to permit the projection to be moved longitudinally in the slot and translate said ceramic rod therewith.

4. A hand held apparatus for sharpening a cutting edge of a cutting tool comprising:

a body having a handle on a first side thereof capable of being firmly gripped by one hand of the operator of the apparatus, said body having a flat bracing surface disposed at a second side of the body opposite its first side such that, when said handle is gripped by said one hand of the operator, said bracing surface can be forcefully urged into positionally stable relation by said one hand of an operator against a fixed support surface such as a table or countertop, floor or wall; and a sharpening element held by said body in a position wherein the cutting edge of the cutting tool being sharpened can be held in a second hand of the operator and drawn along the sharpening element while said bracing surface is being urged against said fixed support surface;

wherein said sharpening element has an exposed sharpening surface along which the cutting edge is drawn when being sharpened, and further comprising means for holding said sharpening element in an orientation such that said exposed sharpening surface is at an angle of approximately 10° relative to said bracing surface.

5. The apparatus according to claim 4 wherein said means for holding includes an elongated plastic retainer, wherein said sharpening element is elongated and configured to be slidably retained within said retainer.

6. The apparatus of claim 4 further comprising a ceramic rod retained on said body for selective movement between retracted and extended positions relative to said body, said ceramic rod when in said extended position being capable of smoothing irregularities or undulations in the cutting edge of said cutting tool in response to the cutting edge being drawn across the ceramic rod.

7. The apparatus of claim 6 wherein said ceramic rod is disposed along said second side of said body, said apparatus further comprising a removable protective cap attachable to said body to cover and protect said ceramic rod, said cap having a flat surface, which is coplanar with said bracing surface when the cap is attached to the body, to thereby enhance the positional stability of the bracing surface against the fixed surface.

8. The apparatus of claim 7 wherein said body has a longitudinally extending slot defined therein, and further comprising a transverse projection extending from said ceramic rod into said slot, said projection being significantly smaller in the lengthwise dimension of said ceramic rod than the length of said slot to permit the projection to be moved longitudinally in the slot and translate said ceramic rod therewith.

* * * * *